US006887008B2

(12) United States Patent
Kitao et al.

(10) Patent No.: US 6,887,008 B2
(45) Date of Patent: May 3, 2005

(54) BALLPOINT PEN TIP, BALLPOINT PEN UTILIZING THE BALLPOINT PEN TIP AND METHOD OF MANUFACTURING THE BALLPOINT PEN TIP

(75) Inventors: Toru Kitao, Yokohama (JP); Hiroyuki Muto, Yokohama (JP)

(73) Assignee: Mitsubishi Pencil Kabushikikaisha, Tokyo (JP)

( * ) Notice: Subject to any disclaimer, the term of this patent is extended or adjusted under 35 U.S.C. 154(b) by 0 days.

(21) Appl. No.: 10/687,831

(22) Filed: Oct. 20, 2003

(65) Prior Publication Data

US 2004/0081507 A1 Apr. 29, 2004

(30) Foreign Application Priority Data

Oct. 21, 2002 (JP) ..... 2002-305750

(51) Int. Cl.[7] ..... B43K 7/10

(52) U.S. Cl. ..... 401/219; 401/209; 401/212; 401/216

(58) Field of Search ..... 401/209, 212, 401/214, 216, 219

(56) References Cited

U.S. PATENT DOCUMENTS 538,492 A * 4/1895 Askew ..... 401/212
2,208,588 A * 7/1940 LaForest ..... 401/212
5,957,609 A * 9/1999 Morita et al. ..... 401/214
6,357,948 B1 * 3/2002 Jung et al. ..... 401/216

FOREIGN PATENT DOCUMENTS

JP 57-4373 U 1/1982
JP 10-236063 A 9/1998

* cited by examiner

*Primary Examiner*—Gregory L. Huson
*Assistant Examiner*—Peter deVore
(74) *Attorney, Agent, or Firm*—Kubovcik & Kubovcik

(57) ABSTRACT

There is provided a ballpoint pen tip that minimizes thin spots such as impact thin spots even if upward writing or an impact causes entry of air, allows rapid return to normal writing, and minimizes manufacturing costs. A writing ball and a check ball included in the ballpoint pen tip are placed close to each other with a slight clearance therebetween to leave an inner space with a slight capacity. Thus, even if air enters from a caulking portion, the volume of the air stored inside is slight, and an air pool can be rapidly eliminated. Further, both the writing ball and the check ball can be provided in a front end of the ballpoint pen tip, and assembly operations can be easily performed without inverting the ballpoint pen tip.

19 Claims, 11 Drawing Sheets

BALLPOINT PEN TIP, BALLPOINT PEN UTILIZING THE BALLPOINT PEN TIP AND METHOD OF MANUFACTURING THE BALLPOINT PEN TIP

BACKGROUND OF THE INVENTION

1. Field of the Invention

The present invention relates to a ballpoint pen tip that can prevent backflow of ink, to a ballpoint pen utilizing the ballpoint pen tip and to a method of manufacturing the ballpoint pen tip.

2. Description of the Prior Art

As writing instruments, ballpoint pens such as oil-based ballpoint pens or gel ink ballpoint pens have been widely used. Such a ballpoint pen generally has a structure that a ballpoint pen tip including a writing ball is provided in a front end thereof, and that an ink-containing portion that contains ink is provided in the rear of the ballpoint pen tip.

Further, the front end of the ballpoint pen tip is generally tapered inward to form a caulking portion in order to prevent detachment of the writing ball from the ballpoint pen tip. Between the caulking portion and the writing ball of the ballpoint pen tip, a predetermined clearance is so formed that the ink passes freely therethrough. Not only the ink but also air can pass through the clearance.

Thus, during writing with a pen point faced upward, the air may enter from between the writing ball and the caulking portion. If the entry of the air is set aside, the ink may flow backward to leak from the rear end of the ink-containing portion. This may cause inconvenience such that writing with the ballpoint pen becomes impossible, or that the leaking ink dirties clothes.

For a gel ink ballpoint pen using gel ink as writing ink, attachment and detachment of a protection cap over a pen point may axially impact a rear end of the ballpoint pen. The impact may cause minute backflow of the ink in the ballpoint pen tip to prevent writing at a writing start or create thin spots in drawn lines, so-called impact thin spots.

In a general ballpoint pen, an opening area of a clearance between a writing ball and a caulking portion becomes larger for a larger diameter of the writing ball, and thus air tends to enter the ballpoint pen tip during writing with the pen faced upward. For example, if a ballpoint pen having a writing ball with a diameter of 0.7 mm or more is used to write with the pen faced upward, air tends to enter the ballpoint pen tip to cause backflow of ink. Particularly, for a gel ink ballpoint pen having a writing ball with a diameter of 0.7 mm or more, air tends to enter the ballpoint pen tip to cause backflow of ink, thus noticeably causing inconvenience such as impact thin spots.

In order to eliminate such inconvenience, a ballpoint pen having a check valve mechanism that prevents backflow of ink is used. Known check valve mechanisms have configurations as described below.

Specifically, a check valve mechanism is known in which a joint, which connects a ballpoint pen tip and an ink-containing tube that contains ink and is mounted therebetween, is provided, a valve-housing chamber that houses a spherical or substantially cylindrical valve is provided in the joint, and the valve is movably placed in the valve-housing chamber (c.f. JP 10-236063 A1). According to the check valve mechanism, when the ballpoint pen is faced upward, the valve closes an ink-passing hole bored in an inner surface of the valve-housing chamber to prevent backflow of the ink.

Another check valve mechanism is known in which a valve-housing chamber that houses a spherical valve is provided in a rear end of a ballpoint pen tip, and with the valve movably housed in the valve-housing chamber, a rear end opening of the ballpoint pen tip is caulked to prevent detachment of the valve (c.f. JP Utility Model Laid-Open No. 57-4373). The check valve mechanism having such a configuration can prevent backflow of the ink.

SUMMARY OF THE INVENTION

As described above, in the ballpoint pen having the check valve mechanism between the ballpoint pen tip and the ink-containing tube, or near the rear end of the ballpoint pen tip, an ink passage that longitudinally passes through the ballpoint pen tip makes communication between a caulking portion at the front end and the check valve mechanism. Therefore, when air enters from the caulking portion, the volume of air stored in the ink passage becomes relatively large.

Thus, even if backflow of the ink can be prevented, once air enters and is stored in the ink passage, it takes time for the ink to fill an air pool. This increases a returning time after the entry of the air makes writing impossible until normal writing becomes possible again.

For the ballpoint pen in which the joint having the check valve mechanism is mounted between the ballpoint pen tip and the ink-containing tube, when the ballpoint pen is manufactured, a step of mounting the writing ball to the front end of the ballpoint pen tip with the front end of the ballpoint pen tip faced upward, and a step of inverting the ballpoint pen tip and mounting the joint having the check valve mechanism to the rear end of the ballpoint pen tip have to be separately performed. This increases the number of processing steps and makes the steps complex, thus increasing manufacturing costs.

On the other hand, for the ballpoint pen in which the check valve mechanism is incorporated near the rear end of the ballpoint pen tip, a step of mounting the writing ball to the front end of the ballpoint pen tip, and a step of assembling the check valve mechanism in the rear end of the ballpoint pen tip have to be separately performed. This increases the number of processing steps and makes the steps complex, thus increasing manufacturing costs, like the ballpoint pen having the configuration in which a part to be the check valve mechanism is mounted between the ballpoint pen tip and the ink-containing tube.

The present invention is made in view of the above problems, and has an object to provide a ballpoint pen tip that minimizes thin spots such as impact thin spots even if upward writing or an impact causes entry of air, allows rapid return to normal writing, and minimizes manufacturing costs, a ballpoint pen utilizing the ballpoint pen tip, and a manufacturing method of the ballpoint pen tip.

First Invention

The first invention of the present invention provides a ballpoint pen tip comprising a writing ball and a check ball, wherein the writing ball and the check ball are placed close to each other with a slight clearance therebetween.

According to the first invention, the writing ball and the check ball are placed close to each other with the slight clearance therebetween, and thus only a slight space is formed between the writing ball and the check ball. Therefore, even if air enters from a caulking portion, the volume of the air stored inside is slight. Thus, even if upward writing or an impact causes entry of air, a minute air pool is rapidly eliminated to reduce a returning time until a restart of writing, thereby rapidly allowing normal writing.

Both the writing ball and the check ball are provided in the front end of the ballpoint pen tip, and thus when the ballpoint pen is manufactured, an operation of mounting the check ball to form a check valve mechanism and an operation of mounting the writing ball can be rapidly performed as a series of operations. Further, such operations can be performed without inverting the ballpoint pen tip. Thus, providing the check valve mechanism does not increase the number of processing steps, allows manufacturing by simple operation steps, and reduces manufacturing costs of the ballpoint pen having the check valve mechanism.

Second Invention

The second invention of the present invention provides the ballpoint pen tip wherein, in addition to the feature of the first invention, the check ball is smaller in diameter than the writing ball.

According to the second invention, in addition to the advantage of the first invention, the check ball being smaller in diameter than the writing ball is used to allow manufacturing of the ballpoint pen tip as described below.

First, a stepped ink guide hole being smaller in diameter at its rear end than at its front end is formed as an ink passage through which ink passes at the front end of the ballpoint pen tip. Next, the check ball is inserted into the stepped ink guide hole, and then the writing ball is inserted into the stepped ink guide hole. Then, the front end is caulked to prevent detachment of the writing ball.

There is no difficulty in processing the stepped ink guide hole, and in inserting the check ball and the writing ball into the ballpoint pen tip. Therefore, providing the check valve mechanism does not increase the number of processing steps. That is, manufacturing can be performed by easy operations to reduce the manufacturing costs of the ballpoint pen having the check valve mechanism.

Third Invention

The third invention of the present invention provides the ballpoint pen tip wherein, in addition to the feature of the first or the second invention, vertical play of the check ball is larger than vertical play of the writing ball.

A valve port that is opened and closed by the check ball is provided in the ballpoint pen tip, and when the check ball moves apart from the valve port within the vertical play, the valve port is opened.

According to the third invention, in addition to the advantage of the first or the second invention, the vertical play of the check ball can be set sufficiently large to secure a sufficient amount of opening of the valve port. This prevents, during writing, a shortage of ink supplied to the writing ball, and thus prevents creation of thin spots caused by the shortage of ink. On the other hand, the vertical play of the writing ball provided in the front end of the ballpoint pen tip may be set smaller than the vertical play of the check ball, and the vertical play may be appropriately set for smooth writing, thus allowing smooth writing without thin spots.

Fourth Invention

The fourth invention of the present invention provides the ballpoint pen tip wherein, in addition to the feature of any one of the first to the third invention, lateral play of the check ball is larger than lateral play of the writing ball.

In the ballpoint pen tip, the ink is supplied to the writing ball through a clearance between an inner peripheral surface of the ballpoint pen tip and the check ball. Thus, if the lateral play of the check ball is sufficiently secured, a width of the clearance through which the ink passes is also sufficiently secured.

According to the fourth invention, in addition to the advantage of any one of the first to the third invention, the lateral play of the check ball may be set sufficiently large to secure the sufficient width of the clearance through which the ink passes. This prevents a shortage of ink supplied to the writing ball, and thus prevents creation of thin spots caused by the shortage of ink during writing. On the other hand, the lateral play of the writing ball provided in the front end of the ballpoint pen tip may be set smaller than the lateral play of the check ball, and the lateral play may be appropriately set for smooth writing, thus allowing smooth writing without thin spots.

Fifth Invention

The fifth invention of the present invention provides the ballpoint pen tip further including, in addition to the feature of any one of the first to the fourth invention, an ink guide hole for guiding ink to the writing ball, channels formed by cutting an inner peripheral surface of the ink guide hole, and a protrusion and a recess that are traces of removed channel burrs being caused when the channels are cut, wherein the protrusion contacts a surface of the check ball to provide a space to be an ink pool between the surface of the check ball and the recess.

Setting an inner diameter of the ink guide hole one step or more larger than the diameter of the check ball to secure a sufficient clearance between the inner peripheral surface of the ink guide hole, the check ball allows a sufficient amount of ink for preventing creation of thin spots during normal writing to be stored in the clearance. However, this may cause excessively large lateral play of the check ball.

According to the fifth invention, in addition to the advantage of any one of the first to the fourth invention, the protrusion and the recess that are the traces of the removed channel burrs are formed in the inner peripheral surface of the ink guide hole to form the space between the surface of the check ball and the recess, thus allowing the sufficient amount of ink for preventing creation of thin spots to be stored in the space during normal writing. Besides, the protrusion contacts the surface of the check ball to prevent excessively large lateral play. Therefore, the ink pool that can store a required amount of ink can be secured, and the amount of lateral play of the check ball can be optimized.

Sixth Invention

The sixth invention of the present invention provides a ballpoint pen comprising the ballpoint pen tip according to any one of the first to the fifth invention, and an ink-containing tube that contains gel ink.

According to the sixth invention, even if air enters, the volume of the air stored inside is slight, and a minute air pool is rapidly eliminated. This reduces a returning time until a restart of writing, thereby rapidly allowing normal writing. Therefore, inconvenience caused by impact thin spots noticeable in a gel ink ballpoint pen is minimized to increase convenience of the gel ink ballpoint pen.

Seventh Invention

The seventh invention of the present invention provides a method of manufacturing the ballpoint pen tip according to any one of the first to the fifth invention, comprising the steps of cutting an ink guide hole for guiding ink, cutting channels in an inner peripheral surface of the ink guide hole, removing channel burrs caused when the channels are cut, and inserting a check ball and a writing ball into the ink guide hole.

According to the seventh invention, the steps of cutting the ink guide hole, cutting the channels, removing the channel burrs, and inserting the check ball and the writing ball are successively performed to prevent difficulty in a manufacturing process. Thus, providing the check valve mechanism does not make the processing steps complex but facilitates the steps. Therefore, the ballpoint pen having the check valve mechanism can be easily manufactured to reduce the manufacturing costs.

DETAILED DESCRIPTION OF THE PREFERRED EMBODIMENTS

Embodiments of the invention will be described with reference to the drawings.

Figure 1:
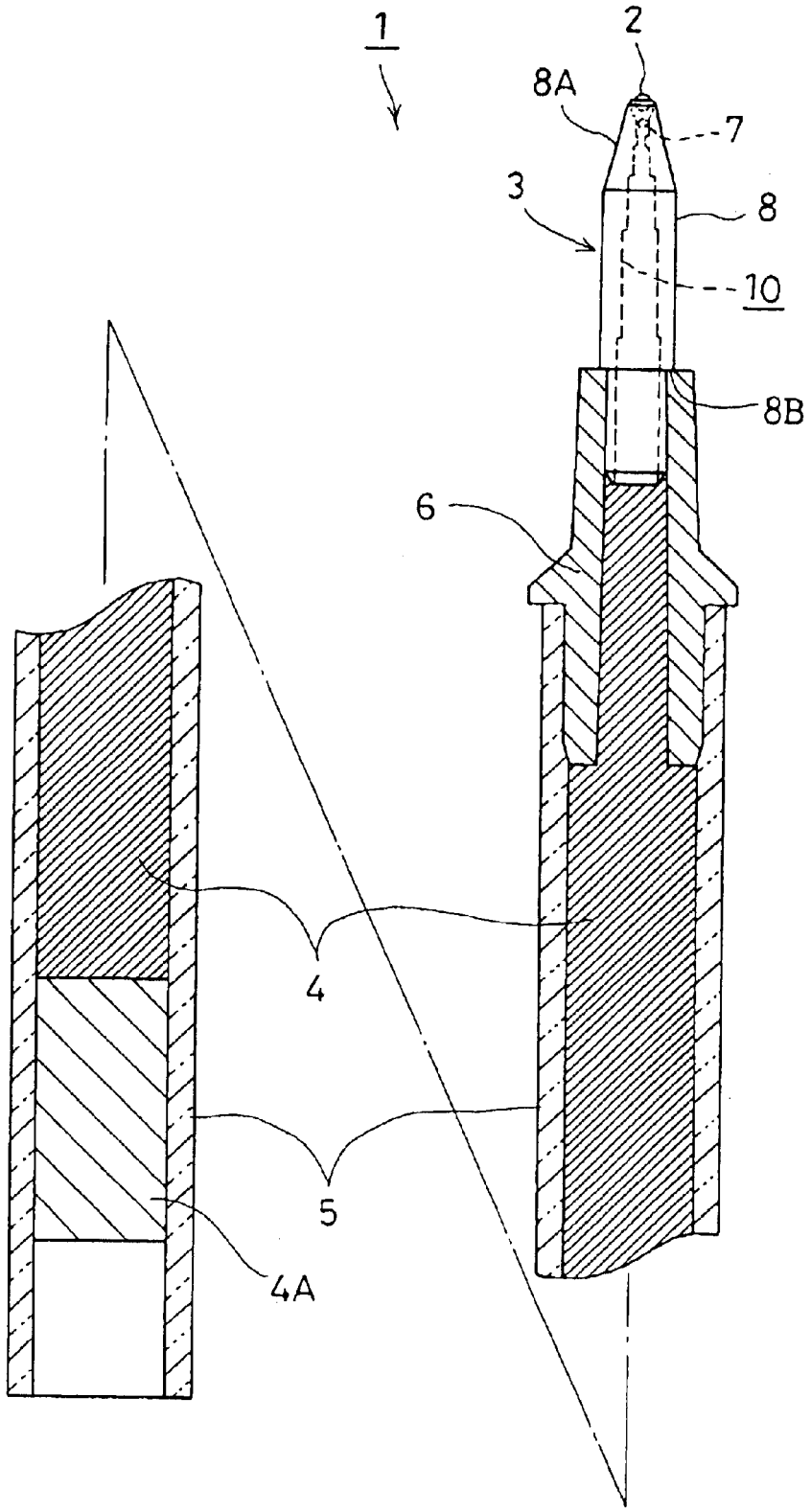
FIG. 1 is a sectional view of a refill of a ballpoint pen according to the first embodiment of the present invention.

A ballpoint pen according to the embodiment has a refill 1 for writing with gel ink. The refill 1 includes, as shown in FIG. 1, a ballpoint pen tip 3 rotatably having a writing ball 2 at a front end thereof, an ink-containing tube 5 that contains gel ink 4, and a joint member 6 that connects the ballpoint pen tip 3 and the ink-containing tube 5 having different diameters. The ballpoint pen has an unshown tubular pen barrel that is gripped by a user of the ballpoint pen and that houses the refill 1. The ink-containing tube 5 contains, besides the gel ink 4, a follower 4A that seals a rear end of the gel ink 4 in order to prevent backflow of the gel ink 4. The ink-containing tube 5 and the joint member 6 are made of synthetic resin.

The joint member 6 has a liquid tight fit with both of the ballpoint pen tip 3 and the ink-containing tube 5.

The follower 4A is a grease substance that follows the gel ink 4 with consumption of the gel ink 4. The follower 4A is incompatible with the gel ink 4, and prevents evaporation of the gel ink 4. As required, an unshown follower rod made of resin having substantially the same specific gravity as the follower 4A is immersed in the follower 4A. The follower 4A may be a follower made of silicone rubber or the like.

The ballpoint pen tip 3 includes, besides the writing ball 2, a check ball 7 for preventing backflow of the gel ink 4 from the writing ball 2 toward the ink-containing tube 5, and a holder 8 that rotatably supports the writing ball 2 and the check ball 7. The writing ball 2 and the check ball 7 are placed closed to each other with a slight clearance therebetween. The check ball 7 is slightly smaller in diameter than the writing ball 2. The holder 8 is a tubular part extending along the length of the refill 1. The holder 8 has an ink guide hole 10 extending along the length thereof and passing there through. A front end 8A of the holder 8 is tapered and formed into a cone. The holder 8 has, in its middle part, a stepped portion 8B being smaller in diameter on the side of a rear end.

Figure 2:
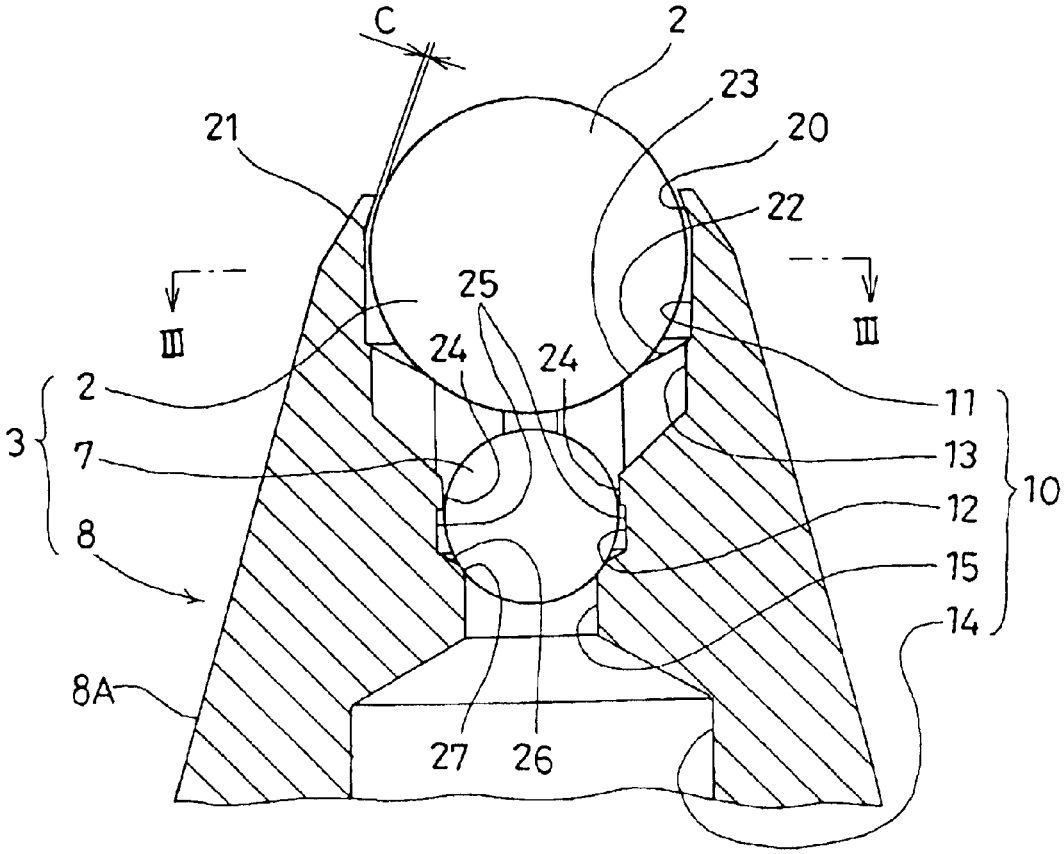
FIG. 2 is an enlarged sectional view of essential portions of the embodiment.
Figure 3:
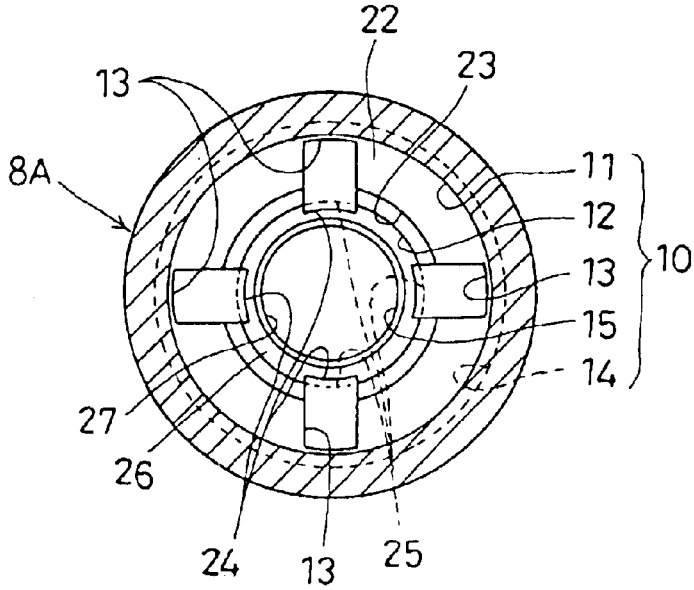
FIG. 3 is a sectional view taken along the line III—III in FIG. 2.

The ink guide hole 10 guides the gel ink 4 to the writing ball 2, extends from the rear end of the holder 8 to the vicinity of the front end 8A in an elongated manner, and has an uneven inner peripheral surface with a changing diameter in the front end 8A. Specifically, as shown in FIGS. 2 and 3, the ink guide hole 10 in the front end 8A has a ball house 11 that is a writing ball chamber that rotatably houses the writing ball 2, a check ball chamber 12 that houses the check ball 7 and that is smaller in diameter than the ball house 11, radial grooves 13 that are a plurality of grooves in an inner peripheral surface of the check ball chamber 12 and radially arranged around a central axis of the holder 8, an ink guide passage 14 extending from the rear end of the holder 8 to the vicinity of the front end 8A, and a narrowing portion 15 that narrows a boundary between the check ball chamber 12 and the ink guide passage 14.

The ball house 11 has, at the front end of the holder 8, an opening 20 for partly exposing the writing ball 2. A side wall of the holder 8 placed around the opening 20 is caulked toward the writing ball 2 to form a caulking portion 21 so as to prevent detachment of the writing ball 2 from the ball house 11. The ball house 11 also has an annular stepped portion 22 along a boundary with the check ball chamber 12. An edge inside the annular stepped portion 22 has a seat portion 23 that receives the writing ball 2. The ball house 11 has a space that slightly allows vertical and lateral play of the writing ball 2.

The check ball chamber 12 is the space that allows the vertical and lateral play of the check ball 7. The vertical play of the check ball 7 in the check ball chamber 12 is larger than the vertical play of the writing ball 2 in the ball house 11. The lateral play of the check ball 7 in the check ball chamber 12 is larger than the lateral play of the writing ball 2 in the ball house 11. Further, the vertical play of the check ball 7 in the check ball chamber 12 is larger than the lateral play thereof. The check ball 7 moves to contact the writing ball 2 during writing.

The radial grooves 13 are channels formed by cutting the inner peripheral surface of the check ball chamber 12 that is a part of the ink guide hole 10, and extend axially of the holder 8. An end of each radial groove 13 on the side of the narrowing portion 15 is placed in the middle of the inner peripheral surface of the check ball chamber 12. The end of the radial groove 13 on the side of the writing ball 2 is open into the ball house 11.

In the inner peripheral surface of the check ball chamber 12 that is a part of the ink guide hole 10, a protrusion 24 and a recess 25 are formed that are traces of removed channel burrs being caused when the radial grooves 13 are cut. The protrusion 24 contacts a surface of the check ball 7 to provide a space to be an ink pool between the surface of the check ball 7 and the recess 25.

The narrowing portion 15 has an annular stepped surface 26 that faces an inside of the check ball chamber 12. An inner edge of the annular stepped surface 26 has a seat portion 27 that receives the check ball 7. When a pen point of the ballpoint pen is faced upward, the check ball 7 is seated in the seat portion 27 to close an opening of the narrowing portion 15. The check ball 7 and the narrowing portion 15 constitute a check valve mechanism. The check valve mechanism prevents backflow toward the ink guide passage 14 of the gel ink 4 guided to the ball house 11 during upward writing.

In such a ballpoint pen tip 3, when manufactured by cutting, the holder 8 may be made of metal materials such as stainless steel, nickel silver or brass. When manufactured by injection molding, the holder 8 may be made of thermoplastic resin materials such as polyethylene resin or polypropylene resin. However, in view of durability, the holder 8 is preferably made of metal materials and manufactured by cutting.

The diameter of the writing ball 2 may be set to 0.4 mm to 1.2 mm, and preferably to 0.4 mm to 0.7 mm. The writing ball 2 may be made of metal materials such as cemented carbide or stainless steel, or sintered materials such as ceramics.

The diameter of the check ball 7 may be set to the same diameter as the writing ball 2, but is preferably slightly smaller than the diameter of the writing ball 2. For example, the diameter of the check ball 7 may be set to 0.31 mm to 0.5 mm, and preferably to 0.31 mm to 0.38 mm. When the diameter of the check ball 7 is set to 0.31 mm to 0.38 mm, an inner diameter of the check ball chamber 12 may be set to 0.35 mm to 0.42 mm.

The check ball 7 may be made of metal materials such as cemented carbide or stainless steel, sintered materials such as ceramics, or thermoplastic resin materials such as polyethylene resin or polypropylene resin.

The caulking portion 21 and a clearance C (see FIG. 2) of the writing ball 2 are set so as to secure a sufficient amount of gel ink 4 to be discharged. When the gel ink 4 is normal gel ink, the clearance C is preferably set to 10 to 50 $\mu$m. On the other hand, when the gel ink 4 is gel ink containing coarse particles as pigments, the clearance C is preferably set to 50 to 150 $\mu$m.

Next, a writing operation of the ballpoint pen tip 3 according to the embodiment will be described.

Figure 4:
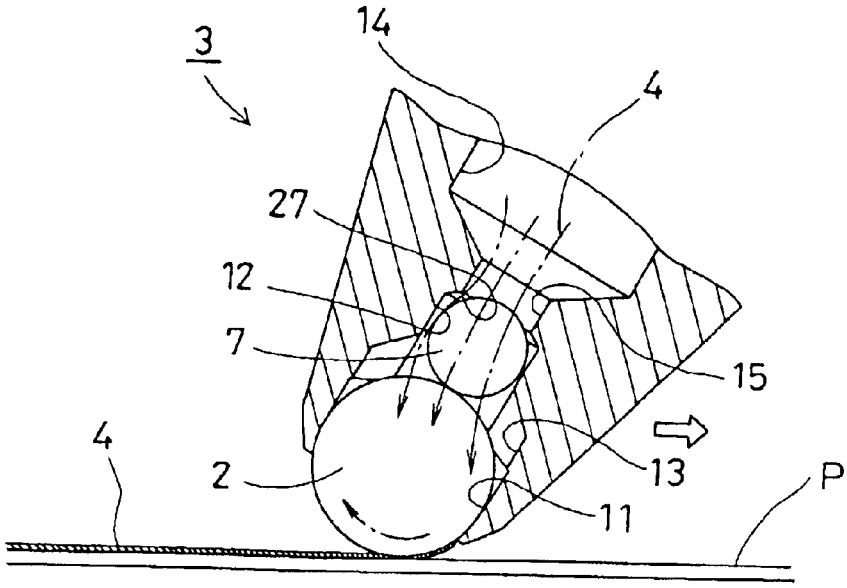
FIG. 4 illustrates an operation during normal writing according to the embodiment.

During normal writing with the pen point faced downward, as shown in FIG. 4, the check ball 7 in the check ball chamber 12 moves apart from the seat portion 27 toward the writing ball 2. This opens the narrowing portion 15, and the gel ink 4 guided to the ink guide passage 14 passes through the narrowing portion 15. The gel ink 4 successively passes through a clearance between the check ball chamber 12 and the check ball 7, and the radial groove 13, reaches the writing ball 2 in the ball house 11, and is transferred to a sheet P by rotation of the writing ball 2. Thus, lines of letters or the like are written.

Figure 5:
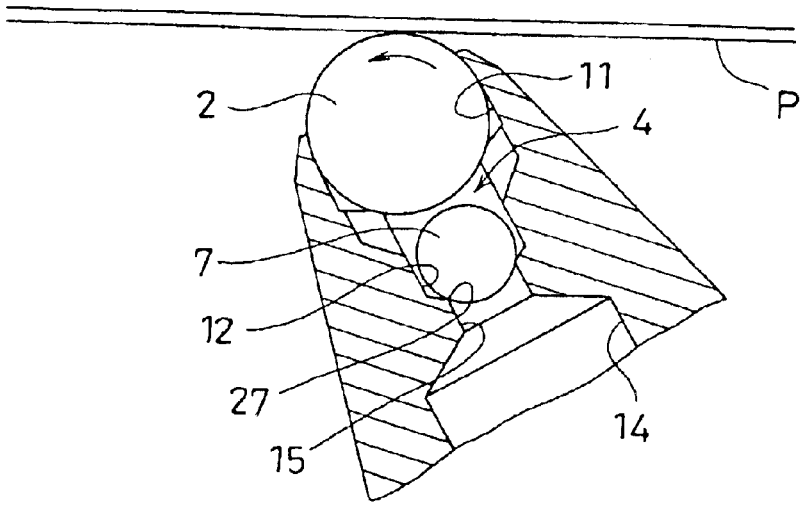
FIG. 5 illustrates an operation during upward writing according to the embodiment.

During upward writing with the pen point faced upward, as shown in FIG. 5, the check ball 7 in the check ball chamber 12 moves toward the narrowing portion 15 and is seated in the seat portion 27. Thus, the narrowing portion 15 is closed, and the gel ink 4 guided to the ball house 11 cannot pass through the narrowing portion 15. This prevents backflow of the gel ink 4 even if the pen point is faced upward. The backflow of the gel ink 4 is prevented, so that a large amount of air is prevented from being stored in the ball house 11, thereby allowing rapid return to normal writing even if the air enters and reducing a returning time.

Next, a manufacturing procedure of the ballpoint pen tip 3 according to the embodiment will be described.

Figure 6:
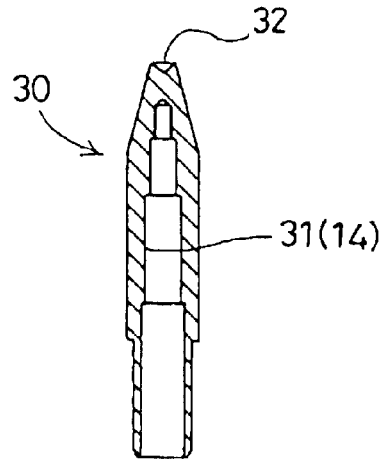
FIG. 6 is a sectional view illustrating a step of manufacturing the ballpoint pen tip according to the embodiment.
Figure 7:
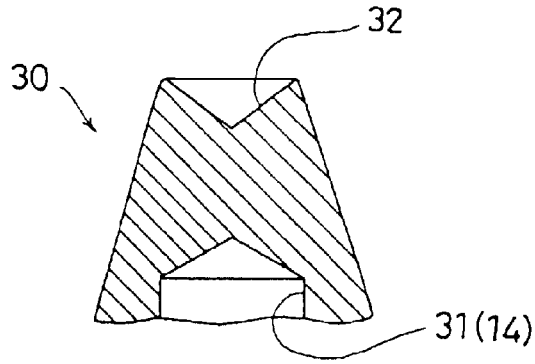
FIG. 7 is a sectional view illustrating a step after the step in FIG. 6.

First, as shown in FIG. 6, a rod-like base material is formed into an outside shape of the ballpoint pen tip 3 by cutting or the like to create a workpiece 30 to be the holder 8 of the ballpoint pen tip 3. Then, a back hole 31 (the ink guide passage 14) that extends along a central axis is formed in the workpiece 30 by a drilling machine such as a ball press, and, as shown in FIG. 7, a central hole 32 that indicates a center is formed in an end surface of the workpiece 30 on the side of the pen point.

Figure 8:
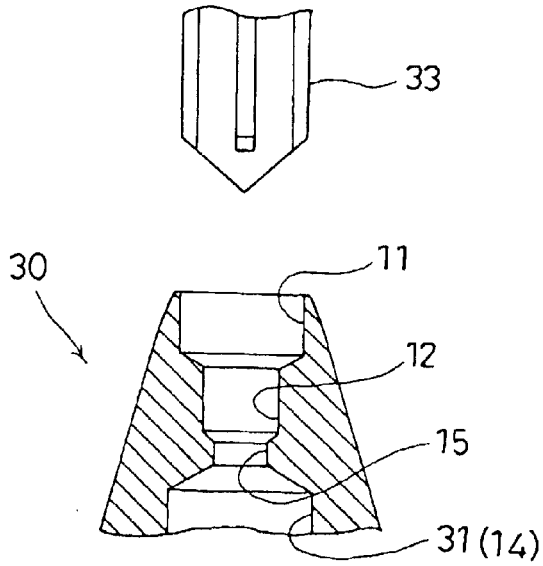
FIG. 8 is a sectional view illustrating a step after the step in FIG. 7.

Then, the drilling machine such as the ball press is used to cut the workpiece 30 to form the ball house 11, the check ball chamber 12, and the narrowing portion 15 in the workpiece 30 as shown in FIG. 8. At this time, the order of cutting the ball house 11, the check ball chamber 12, and the narrowing portion 15 may be any of the following orders a) to d).

a) Cutting in the order of the check ball chamber 12, the narrowing portion 15, and the ball house 11.

b) Cutting in the order of the check ball chamber 12, the ball house 11, and the narrowing portion 15.

c) Cutting in the order of the narrowing portion 15, the check ball chamber 12, and the ball house 11.

d) Cutting in the order of the ball house 11, the check ball chamber 12, and the narrowing portion 15.

Figure 9:
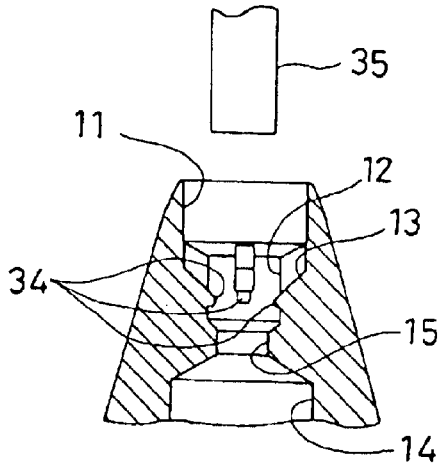
FIG. 9 is a sectional view illustrating a step after the step in FIG. 8.

Then, a grooving broach 33 is used to cut the inner peripheral surface of the check ball chamber 12 to form a plurality of radial grooves 13 in the inner peripheral surface of the check ball chamber 12 as shown in FIG. 9. At this time, cutting the radial grooves 13 using the broach 33 causes channel burrs 34 on the inner peripheral surface of the check ball chamber 12 on the side of the ink guide passage 14 of the radial grooves 13.

Figure 10:
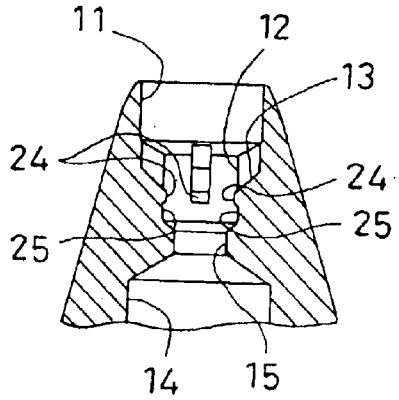
FIG. 10 is a sectional view illustrating a step after the step in FIG. 9.

After the radial grooves 13 are formed, a finishing broach 35 is used to remove the channel burrs 34. At this time, the channel burrs 34 are not completely removed, but, as shown in FIG. 10, the channel burrs 34 are removed so as to partly leave traces of the channel burrs 34 on the inner peripheral surface of the check ball chamber 12 to form the protrusion 24 and the recess 25 that are the traces of the removed channel burrs 34.

Figure 11:
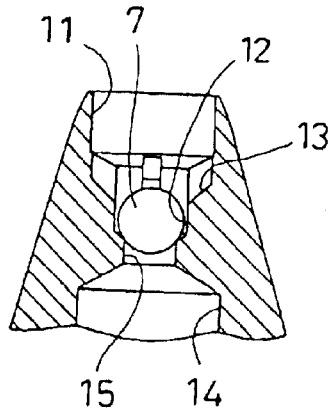
FIG. 11 is a sectional view illustrating a step after the step in FIG. 10.
Figure 12:
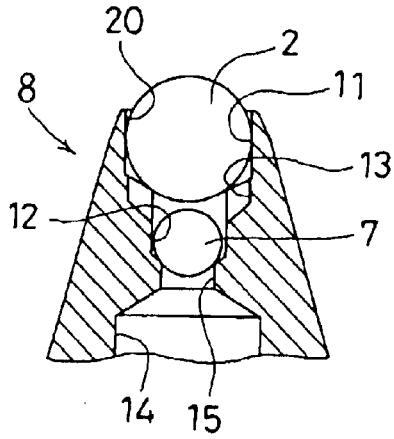
FIG. 12 is a sectional view illustrating a step after the step in FIG. 11.

Next, as shown in FIG. 11, the check ball 7 is inserted into the check ball chamber 12, and then, as shown in FIG. 12, the writing ball 2 is inserted into the ball house 11, and the check ball 7 and the writing ball 2 are placed close to each other with a slight clearance therebetween in the holder 8.

Figure 13:
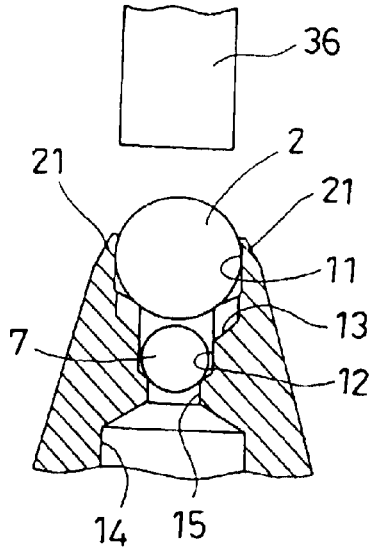
FIG. 13 is a sectional view illustrating a step after the step in FIG. 12.

Then, the side wall of the holder 8 placed around the opening 20 is caulked toward the writing ball 2 to form the caulking portion 21 so as to prevent detachment of the writing ball 2 from the ball house 11, as shown in FIG. 13.

Figure 14:
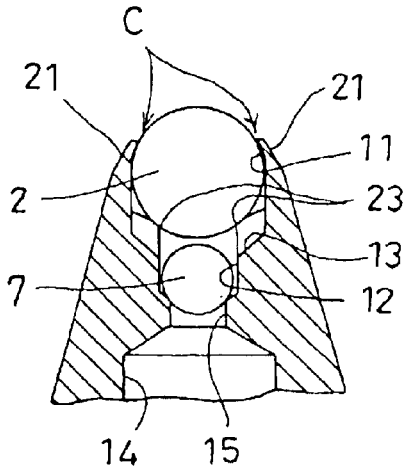
FIG. 14 is a sectional view illustrating a step after the step in FIG. 13.

After the caulking portion 21 is formed, a hammer 36 driven by a pressing device or the like is used to hammer the writing ball 2 housed in the ball house 11. Thus, as show in FIG. 14, the clearance C of a predetermined size is formed between the writing ball 2 and the caulking portion 21, and the seat portion 23 that receives the writing ball 2 is formed in the ball house 11. Thus, production of the ballpoint pen tip 3 is completed.

According to the above-described embodiment, the following advantages can be obtained.

Specifically, the writing ball 2 and the check ball 7 are placed close to each other with the slight clearance therebetween in the holder 8, and thus only a slight space is formed between the writing ball 2 and the check ball 7. Therefore, even if air enters from the caulking portion 21, the volume of the air stored inside is slight. Thus, even if upward writing or an impact causes entry of air, a minute air pool is rapidly eliminated to reduce a returning time until a restart of writing, thereby rapidly allowing normal writing.

Both the writing ball 2 and the check ball 7 are provided in the front end of the ballpoint pen tip 3, and are housed in the holder 8 from the side of the ball house 11. Thus, when the ballpoint pen tip 3 is manufactured, an operation of mounting the check ball 7 to the ballpoint pen tip 3 to form the check valve mechanism and an operation of mounting the writing ball 2 to the ballpoint pen tip 3 can be rapidly performed as a series of operations. Further, such operations can be performed without inverting the ballpoint pen tip 3. Thus, providing the check valve mechanism does not increase the number of processing steps, allows manufacturing by simple operation steps, and reduces the manufacturing costs of the ballpoint pen having the check valve mechanism.

Further, the check ball 7 is smaller in diameter than the writing ball 2, and the check ball chamber 12 being smaller in diameter than the ball house 11 is provided on the side of the rear end of the ball house 11. Thus, the check ball 7 is inserted into the check ball chamber 12, then the writing ball 2 is inserted into the ball house 11, and the front end is caulked to prevent detachment of the writing ball 2, thereby facilitating manufacturing of the ballpoint pen tip 3. There is no difficulty in processing the check ball chamber 12, and inserting the check ball 7 and the writing ball 2 into the ballpoint pen tip 3. Therefore, providing the check valve mechanism does not increase the number of processing steps to allow manufacturing by easy operations. This also reduces the manufacturing costs of the ballpoint pen having the check valve mechanism.

The vertical play of the check ball 7 is set larger than the vertical play of the writing ball 2 to secure a sufficient amount of opening of the narrowing portion 15 as a valve port provided in the check valve mechanism. This prevents a shortage of ink supplied to the writing ball 2 during writing, and thus prevents creation of thin spots caused by the shortage of ink. On the other hand, the vertical play of the writing ball 2 provided in the front end of the ballpoint pen tip 3 may be set sufficiently smaller than the vertical play of the check ball 7 for smooth writing, thus allowing smooth writing without thin spots.

The lateral play of the check ball 7 is set larger than the lateral play of the writing ball 2 to secure a sufficient width of the clearance between the inner peripheral surface of the check ball chamber 12 and the check ball 7 during writing. This prevents a shortage of ink supplied to the writing ball 2, and thus prevents creation of thin spots caused by the shortage of ink. On the other hand, the lateral play of the writing ball 2 provided in the front end of the ballpoint pen tip 3 may be set sufficiently smaller than the lateral play of the check ball 7 for smooth writing, thus allowing smooth writing without thin spots.

The protrusion 24 and the recess 25 that are the traces of the removed channel burrs 34 are formed in the inner peripheral surface of the check ball chamber 12 to form the space between the surface of the check ball 7 and the recess 25, and thus the sufficient amount of gel ink 4 for preventing creation of the thin spots during normal writing can be stored in the space. Besides, the protrusion 24 contacts the surface of the check ball 7 to prevent excessively large lateral play. Therefore, the ink pool that can store a required amount of gel ink 4 can be secured, and the amount of lateral play of the check ball 7 can be optimized.

Further, the check valve mechanism constituted by the check ball 7 and the narrowing portion 15 is provided in the ballpoint pen tip 3 of the gel ink ballpoint pen using the gel ink 4 for writing, and even if air enters, the volume of the air stored inside is slight, and the air pool is rapidly eliminated. This reduces a returning time until a restart of writing, thereby rapidly allowing normal writing. Therefore, the inconvenience caused by the impact thin spots noticeable in the gel ink ballpoint pen is minimized, thus increasing convenience of the gel ink ballpoint pen, particularly a gel ink ballpoint pen having a writing ball 2 with a diameter of 7 mm or more.

The steps of cutting the ball house 11 to be the ink guide hole 10, the check ball chamber 12 and the ink guide passage 14, cutting the radial grooves 13, removing the channel burrs 34, and inserting the check ball 7 and the writing ball 2 into the holder 8 are successively performed to prevent difficulty in the manufacturing process. Thus, providing the check valve mechanism does not make the processing steps complex but facilitates the steps. Therefore, the ballpoint pen having the check valve mechanism can be easily manufactured to reduce the manufacturing costs.

Figure 15:
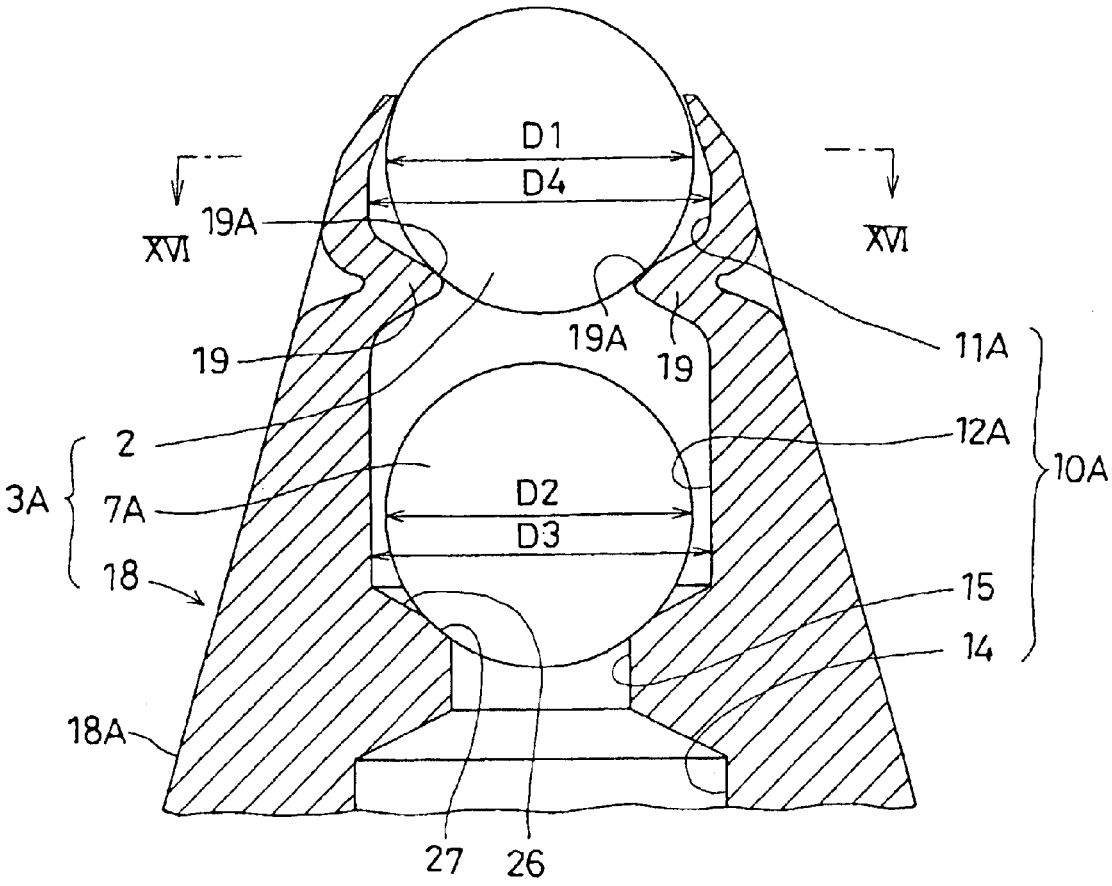
FIG. 15 is a sectional view of a ballpoint pen tip according to the second embodiment of the present invention.
Figure 16:
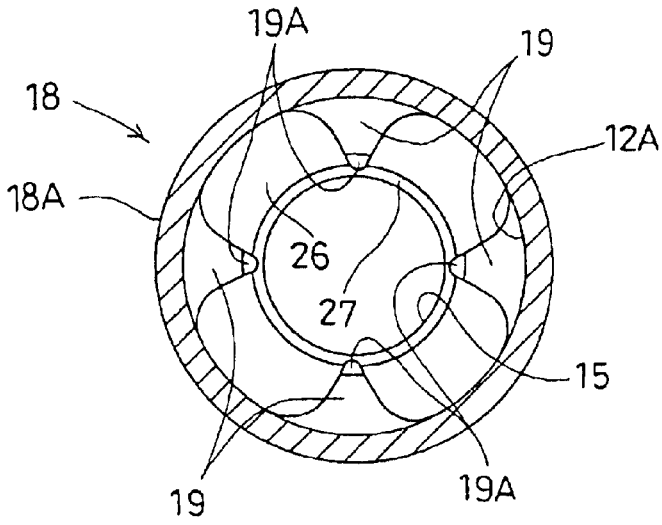
FIG. 16 is a sectional view taken along the line XVI—XVI in FIG. 15.

FIGS. 15 and 16 show the second embodiment of the invention. In this embodiment, the check ball 7 being smaller in diameter than the writing ball 2 in the first embodiment is replaced by a check ball 7A having the same diameter as the writing ball 2.

Specifically, a refill 1 according to the second embodiment is for writing with gel ink 4 as in the first embodiment, and has a ballpoint pen tip 3A in a front end thereof. As shown in FIG. 15, the ballpoint pen tip 3A includes a writing ball 2 and the check ball 7A having the same diameter, and a holder 18 that houses the writing ball 2 and the check ball 7A in a front end 18A. In FIG. 15, the diameter D1 of the writing ball 2 and the diameter D2 of the check ball 7A are the same.

Like the holder 8 in the first embodiment, the holder 18 has an ink guide hole 10A extending along the length thereof and passing there through. The ink guide hole 10A has an uneven inner peripheral surface with a changing inner diameter in the front end 18A of the holder 18. Specifically, the ink guide hole 10A in the front end 18A has a ball house 11A that houses the writing ball 2, a check ball chamber 12A that houses the check ball 7, an ink guide passage 14 extending from a rear end of the holder 18 to the vicinity of the front end 18A, and a narrowing portion 15 that narrows a boundary between the check ball chamber 12A and the ink guide passage 14.

At this time, an inner diameter D3 of the check ball chamber 12A is set one step larger than a diameter D2 of the check ball 7. Thus, a sufficiently large clearance is formed between the inner peripheral surface of the check ball chamber 12A and the surface of the check ball 7, and a sufficient amount of gel ink 4 passes through the clearance. The radial grooves 13 in the first embodiment are omitted from the inner peripheral surface of the check ball chamber 12A.

The inner diameter D3 of the check ball chamber 12A is substantially the same as an inner diameter D4 of the ball house 11A. On a side wall of the holder 18, a boundary between the check ball chamber 12A and the ball house 11A is partly caulked. Thus, as shown in FIGS. 15 and 16, the annular portion has a cone-shaped receiving portion 19 protruding inward from the inner peripheral surface of the side wall of the holder 18 and tapered. A front end of the receiving portion 19 has a seat portion 19A that receives the writing ball 2.

In the second embodiment, similar operations and advantages as the first embodiment can be achieved, and, besides, the following advantage can be added.

Specifically, the check ball 7A having the same size as the writing ball 2 is used, and thus the same type of part can be used for the writing ball 2 and the check ball 7, thus reducing the number of types of parts. This significantly reduces manufacturing costs in mass-manufacturing of ballpoint pens.

Next, the effects of the present invention will be described based on specific examples.

EXAMPLE 1

In Example 1, a ballpoint pen 1 according to the first embodiment was used to conduct some tests. In the ballpoint pen 1 of Example 1, the ballpoint pen tip of a commercially available ballpoint pen (UM-151, Mitsubishi Pencil) was replaced by the ballpoint pen tip 3 having the writing ball 2 and the check ball 7, as shown in FIG. 17.

The ballpoint pen 1 had specifications as described below. In FIG. 17, the protrusion 24 formed on the inner peripheral surface of the check ball chamber 12 is unshown.

Specification of the Ballpoint Pen 1

Figure 17:
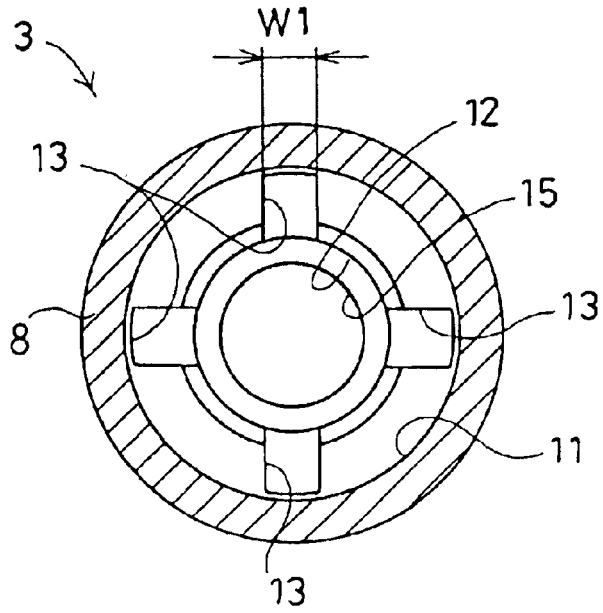
FIG. 17 shows a cross sectional view and a vertical sectional view of Example 1 based on the present invention.
Figure 17:
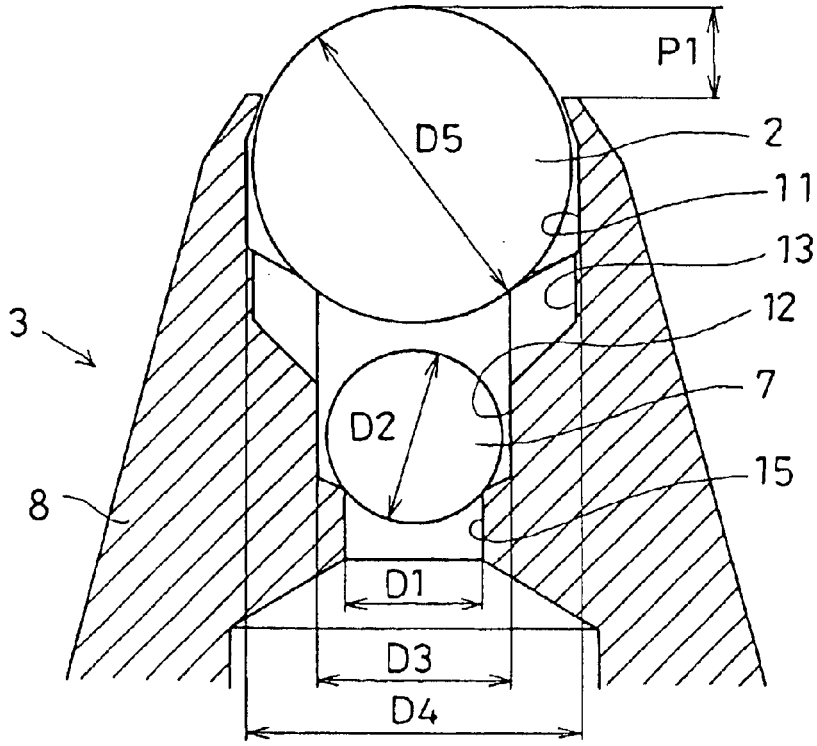

(a) Sizes of Each Portion (See FIG. 17)

The inner diameter D1 of the narrowing portion of the ballpoint pen tip 3: 0.30 mm.

The diameter D2 of the check ball 7: 0.38 mm.

The inner diameter D3 of the check ball chamber 12: 0.42 mm.

The inner diameter D4 of the ball house 11: 0.72 mm.

The diameter D5 of the writing ball 2: 0.70 mm.

The size of protrusion P1 of the writing ball 2 (the amount of protrusion from the front end of the ballpoint pen tip 3): 0.21 mm.

The width W1 of the radial groove: 0.12 mm.

(b) Material of Each Portion

The holder 8 of the ballpoint pen tip 3: ferritic stainless steel SUS430.

The writing ball 2 and the check ball 7: cemented carbide ball.

The joint member 6: synthetic resin such as polypropylene or polyacetal.

The ink-containing tube 5: synthetic resin such as polypropylene.

(c) Composition or the Like of the Gel Ink 4

Viscosity characteristics: viscosity at a temperature of 25° C. and at a shear rate of 38.4 $sec^{-1}$ was 100 mPa·sec.

Composition: Carbon black: 7.0% by weight, styrene acrylate resin ammonium group: 3.0% by weight, ethylene glycol: 20.0% by weight, potash soap (lubricant): 0.4% by weight, sodium OMADINE (preservative): 0.2% by weight, amino methyl propanol (pH adjustor): 0.3% by weight, benzotriazole (rust inhibitor): 0.2% by weight, polyacrylate (acrylic synthetic polymer): 0.1% by weight, ion-exchanged water: balance.

COMPARATIVE EXAMPLE 1

In Comparative Example 1, a ballpoint pen 60 in which the check ball 7 was omitted from the ballpoint pen 1 of Example 1 was used to conduct some tests.

Figure 18:
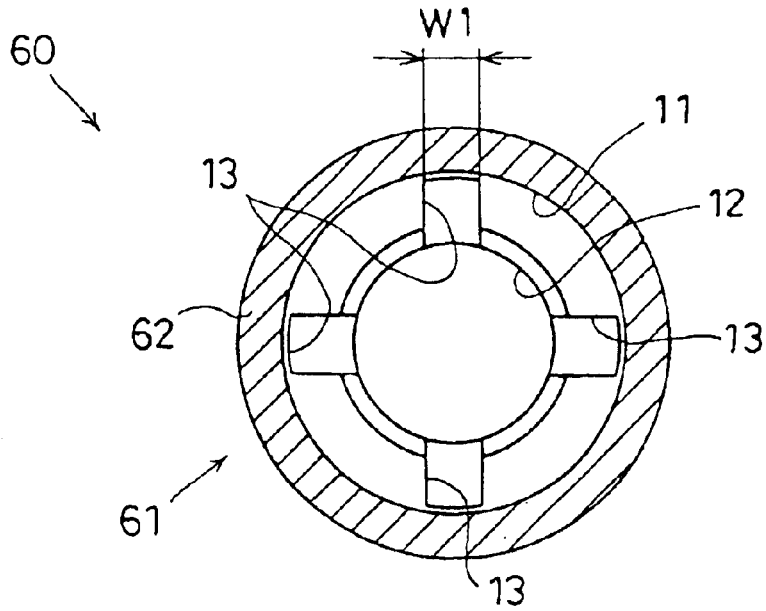
FIG. 18 shows a cross sectional view and a vertical sectional view of Comparative Example 1.
Figure 18:
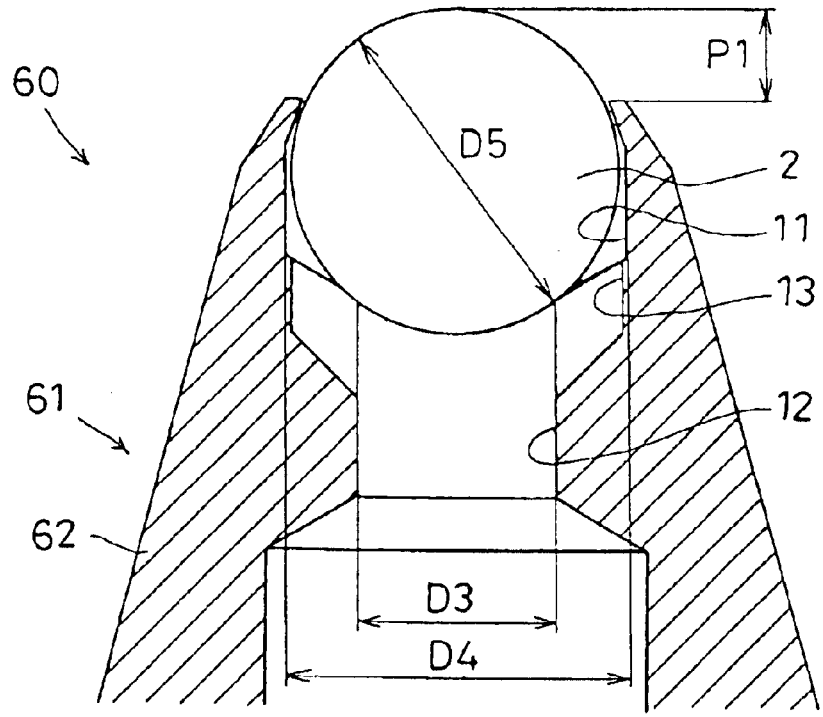
Figure 19:
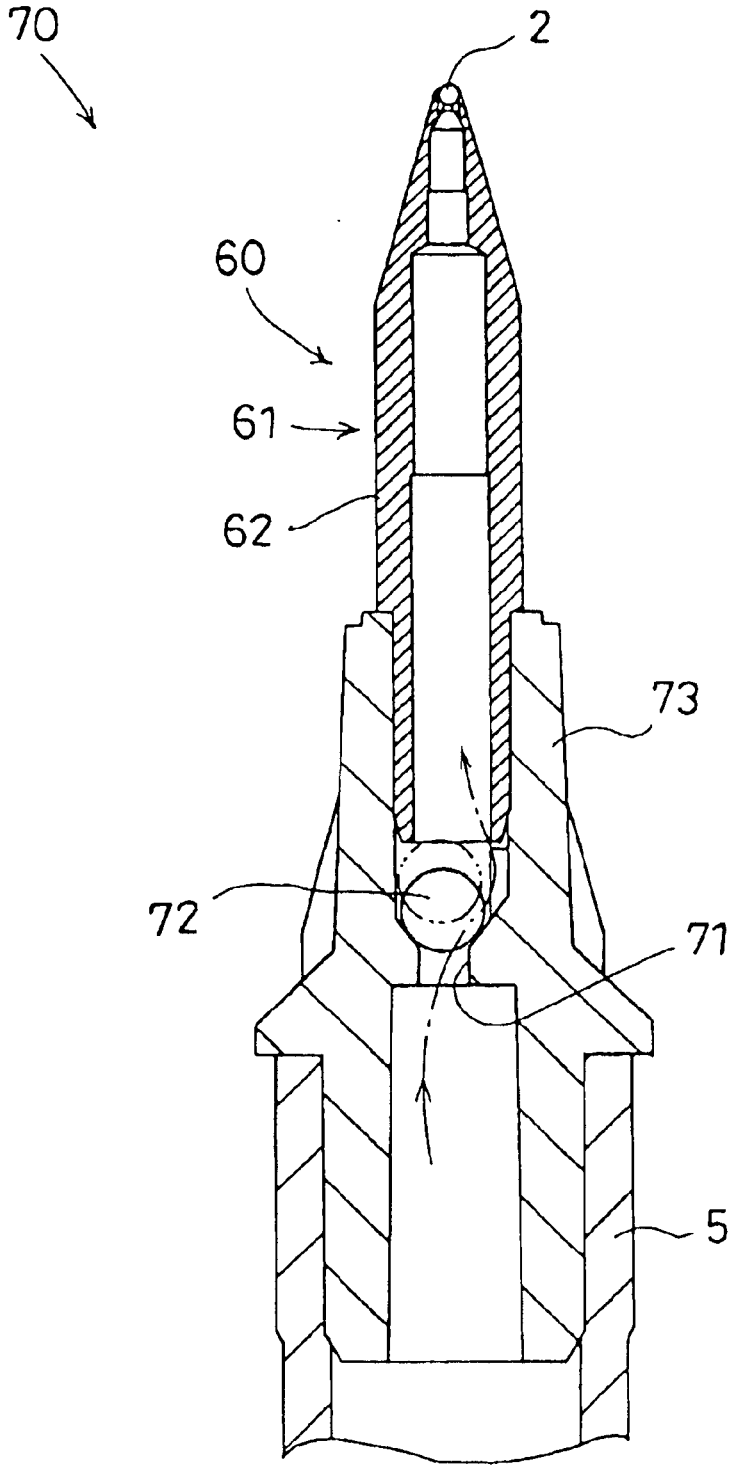
FIG. 19 is a vertical sectional view of Comparative Example 2.

Specifically, as shown in FIG. 18, the ballpoint pen 60 of Comparative Example 1 was the same as the ballpoint pen 1 of Example 1 except that the check ball 7 was omitted from an inside of a ballpoint pen tip 61, and the narrowing portion 15 and the protrusion 24 were omitted from a holder 62 of the ballpoint pen tip 61.

COMPARATIVE EXAMPLE 2

In Comparative Example 2, a ballpoint pen 70 in which a distance between the writing ball 2 and the check ball 7 placed close to each other in Example 1 was significantly increased was used to conduct some tests.

The ballpoint pen 70 of Comparative Example 2 was the same as the ballpoint pen 60 of Comparative Example 1 except that a narrowing portion 71 was formed on the inner peripheral surface instead of the joint member 6 of Comparative Example 1, and a joint member 73 that houses a check ball 72 was provided.

Specifically, then arrowing portion 71 of the joint member 73 was placed in the middle along the length of the joint member 73 and protrudes inward from an inner peripheral surface of the joint member 73. The check ball 72 was placed between the narrowing portion 71 and the ballpoint pen tip 61. Thus, facing a pen point of the ballpoint pen 70 upward caused the check ball 72 to close the narrowing portion 71 to prevent significant backflow of the gel ink 4.

Methods of Tests

For Example 1 and Comparative Examples 1 and 2, tests described in the following items (1) to (3) were conducted as tests for evaluation of the examples. Five samples were prepared for each of Example 1 and Comparative Examples 1 and 2, and the following tests (1) to (3) were conducted for each of the five samples.

(1) Backflow Test

With the pen point faced upward, an upward drawing motion of freehand drawing of circles having a diameter of 20 to 25 mm was performed. After the drawing line broke and then 10 to 15 circles were further drawn, the upward drawing motion was finished. The writing speed in the upward drawing motion of this backflow test was 3 to 5 circles per second. Then, with the pen tip kept faced upward, the ballpoint pen was set aside, and a leakage of the gel ink 4 from the rear end of the ink-containing tube 5 was visually checked in 30 seconds since the upward drawing motion was finished.

(2) Backflow Returning Test

With the pen point faced upward, an upward drawing motion of freehand drawing of circles having a diameter of 20 to 25 mm was performed. After the drawing line broke and then 3 to 5 circles were further drawn, the upward drawing motion was finished. The writing speed in the upward drawing motion of this backflow returning test was 3 to 5 circles per second. After the upward drawing motion was finished, the pen point was immediately faced downward, and in this state, a normal drawing motion of freehand drawing of circles having a diameter of 20 to 25 mm was started. The writing speed in the normal drawing motion of this backflow returning test was 3 to 5 circles per second. Then, the length of a thin line, which was caused between when the pen point was faced downward and when a normal line was drawn, was measured.

(3) Impact Thin Spot Test

The rear end opposite to the pen point was on the top, the ballpoint pen was placed in a predetermined position above a glass plate so that the rear end was 60 to 80 cm above the glass plate, and the ballpoint pen was dropped from the predetermined position three times. After the three drops, the pen point was immediately faced downward, and in this state, a normal drawing motion of freehand drawing of circles having a diameter of 20 to 25 mm was performed. The writing speed in the normal drawing motion of this impact thin spot test was 3 to 5 circles per second. Then, the length of a thin line, which was caused between when the normal drawing motion was started and when a normal line was drawn, was measured.

Results of the Tests

Table 1 shows results of the backflow test, the backflow returning test, and the impact thin spot test.

TABLE 1

| | Test items | | |
|---|---|---|---|
| | Backflow test (presence or absence of backflow) | Backflow returning test (length of thin line) | Impact thin spot test (length of thin line) |
| Example 1 | No backflow (0/5) | Thin line of the length of a half circle | Thin line of the length of 5 to 10 mm |
| Comparative Example 1 | Backflow occurred in all samples (5/5) | No return, Writing impossible because of backflow | Thin line of the length of 3 to 4 circles |
| Comparative Example 2 | No backflow (0/5) | Thin line of the length of 2 to 3 circles | Thin line of the length of 1 to 2 circles |

The above test results reveal that according to Example 1 based on the invention, the backflow of the gel ink 4 is slight to prevent the leakage of the gel ink 4 from the rear end of the ink-containing tube 5. It also reveals that even if the drawing line breaks in the upward drawing motion, moving to the normal drawing motion allows a rapid start of normal drawing. It further reveals that even if the impact is applied, significant creation of thin spots caused by the impact can be prevented.

The invention is not limited to the above embodiments, but covers variations or improvements within the scope where the object of the invention can be achieved.

Specifically, the ballpoint pen is not limited to the one using gel ink for writing, but maybe an oil-based ballpoint pen using oil-based ink for writing or a water-based ballpoint pen using water-based ink for writing.

Figure 20:
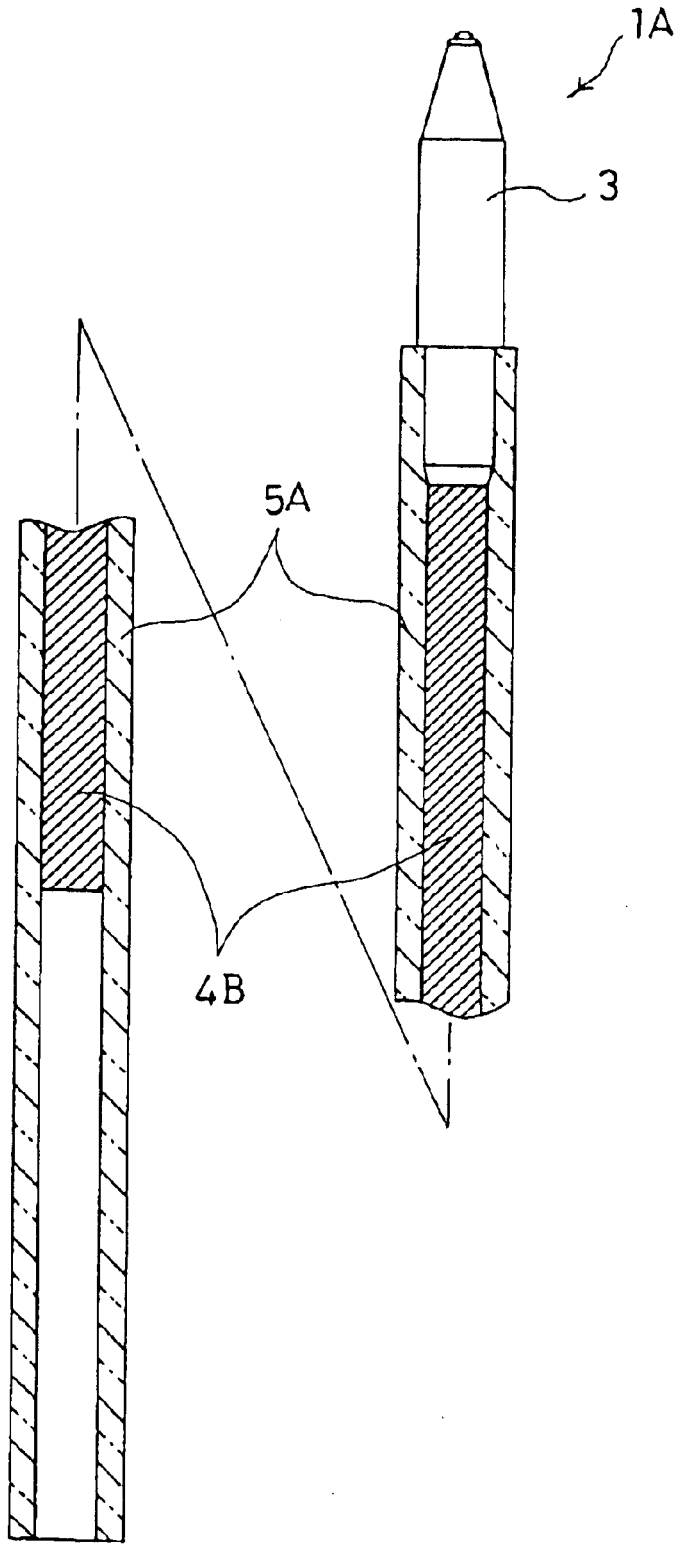
FIG. 20 is a sectional view of a refill according to a variation of the present invention.

Further, as shown in FIG. 20, when an ink-containing tube 5A that contains oil ink 4B is relatively thin, the ink-containing tube 5A can be directly connected to a ballpoint pen tip 3, and thus a joint member 6 for connecting members having significantly different diameters is not required in connection to the ballpoint pen tip 3, and the ink-containing tube SA and the ballpoint pen tip 3 directly connected can be used as a refill 1A. Similarly, when an ink-containing tube that contains gel ink or water-based ink is relatively thin, the ink-containing tube and a ball pen tip can be directly connected, and thus the ink-containing tube and the ballpoint pen tip directly connected can be used as a refill.

What is claimed is:

1. A ballpoint pen tip comprising a writing ball and a check ball, the writing ball and the check ball being placed close to each other with a clearance therebetween, said clearance being such that the check ball moves away from and separates from the writing ball when a tip end of said ballpoint pen tip is directed upward and moves toward and comes into contact with the writing ball when the tip end of said ballpoint pen tip is directed downward.

2. The ballpoint pen tip according to claim 1, wherein the check ball is smaller in diameter than the writing ball.

3. The ballpoint pen tip according to claim 1, wherein vertical play of the check ball is larger than vertical play of the writing ball.

4. The ballpoint pen tip according to claim 2, wherein vertical play of the check ball is larger than vertical play of the writing ball.

5. The ballpoint pen tip according to claim 1, wherein lateral play of the check ball is larger than lateral play of the writing ball.

6. The ballpoint pen tip according to claim 2, wherein lateral play of the check ball is larger than lateral play of the writing ball.

7. The ballpoint pen tip according to claim 3, wherein lateral play of the check ball is larger than lateral play of the writing ball.

8. The ballpoint pen tip according to claim 4, wherein lateral play of the check ball is larger than lateral play of the writing ball.

9. The ballpoint pen tip according to claim 1, further comprising:

an ink guide hole for guiding ink to the writing ball;

channels formed by cutting an inner peripheral surface of the ink guide hole; and a protrusion and a recess that are traces of removed channel burrs being caused when the channels are cut;

wherein the protrusion contacts a surface of the check ball to provide a space to be an ink pool between the surface of the check ball and the recess.

10. The ballpoint pen tip according to claim 2, further comprising:

an ink guide hole for guiding ink to the writing ball;

channels formed by cutting an inner peripheral surface of the ink guide hole; and a protrusion and a recess that are traces of removed channel burrs being caused when the channels are cut;

wherein the protrusion contacts a surface of the check ball to provide a space to be an ink pool between the surface of the check ball and the recess.

11. The ballpoint pen tip according to claim 3, further comprising:

an ink guide hole for guiding ink to the writing ball;

channels formed by cutting an inner peripheral surface of the ink guide hole; and a protrusion and a recess that are traces of removed channel burrs being caused when the channels are cut;

wherein the protrusion contacts a surface of the check ball to provide a space to be an ink pool between the surface of the check ball and the recess.

12. The ballpoint pen tip according to claim 4, further comprising:

an ink guide hole for guiding ink to the writing ball;

channels formed by cutting an inner peripheral surface of the ink guide hole; and a protrusion and a recess that are traces of removed channel burrs being caused when the channels are cut;

wherein the protrusion contacts a surface of the check ball to provide a space to be an ink pool between the surface of the check ball and the recess.

13. The ballpoint pen tip according to claim 5, further comprising:

an ink guide hole for guiding ink to the writing ball;

channels formed by cutting an inner peripheral surface of the ink guide hole; and a protrusion and a recess that are traces of removed channel burrs being caused when the channels are cut;

wherein the protrusion contacts a surface of the check ball to provide a space to be an ink pool between the surface of the check ball and the recess.

14. The ballpoint pen tip according to claim 6, further comprising:

an ink guide hole for guiding ink to the writing ball;

channels formed by cutting an inner peripheral surface of the ink guide hole; and a protrusion and a recess that are traces of removed channel burrs being caused when the channels are cut;

wherein the protrusion contacts a surface of the check ball to provide a space to be an ink pool between the surface of the check ball and the recess.

15. The ballpoint pen tip according to claim 7, further comprising:

an ink guide hole for guiding ink to the writing ball;

channels formed by cutting an inner peripheral surface of the ink guide hole; and a protrusion and a recess that are traces of removed channel burrs being caused when the channels are cut;

wherein the protrusion contacts a surface of the check ball to provide a space to be an ink pool between the surface of the check ball and the recess.

16. The ballpoint pen tip according to claim 8, further comprising:

an ink guide hole for guiding ink to the writing ball;

channels formed by cutting an inner peripheral surface of the ink guide hole; and a protrusion and a recess that are traces of removed channel burrs being caused when the channels are cut;

wherein the protrusion contacts a surface of the check ball to provide a space to be an ink pool between the surface of the check ball and the recess.

17. A ballpoint pen comprising:

a ballpoint pen tip comprising a writing ball and a check ball, the writing ball and the check ball being placed close to each other with a clearance therebetween, said clearance being such that the check ball moves away from and separates from the writing ball when a tip end of said ballpoint pen tip is directed upward and moves toward and comes into contact with the writing ball when the tip end of said ballpoint pen tip is directed downward; and an ink-containing tube that contains gel ink.

18. The ballpoint pen according to claim 17;

the check ball being smaller in diameter than the writing ball, vertical play of the check ball being larger than vertical play of the writing ball, lateral play of the check ball being larger than lateral play of the writing ball, and the ballpoint pen tip further comprising:

an ink guide hole for guiding ink to the writing ball;

channels formed by cutting an inner peripheral surface of the ink guide hole; and a protrusion and a recess that are traces of removed channel burrs being caused when the channels are cut;

wherein the protrusion contacts a surface of the check ball to provide a space to be an ink pool between the surface of the check ball and the recess.

19. A method of manufacturing a ballpoint pen tip, comprising the steps of:

cutting an ink guide hole for guiding ink;

cutting channels in an inner peripheral surface of the ink guide hole;

incompletely removing channel burrs caused when the channels are cut, to form a protrusion and a recess from traces of the burrs;

inserting a check ball into a part of the ink guide hole where the channels are cut; and inserting a writing ball on the tip end side of the check ball.

* * * * *